US005363571A

United States Patent [19]

Montfort

[11] Patent Number: 5,363,571

[45] Date of Patent: Nov. 15, 1994

[54] SKI BOOT CLOSING COVER WITH TIGHTENING DEVICE

[75] Inventor: Benoit Montfort, Annecy, France

[73] Assignee: Salomon S.A., Chavanod, France

[21] Appl. No.: 648,982

[22] Filed: Jan. 31, 1991

[30] Foreign Application Priority Data

Jan. 31, 1990 [FR] France ..... 90 01156

[51] Int. Cl.[5] ..... A43B 5/04; A43B 5/16

[52] U.S. Cl. ..... 36/119; 36/120

[58] Field of Search ..... 36/117, 118, 119, 120, 36/121

[56] References Cited

U.S. PATENT DOCUMENTS

| | | | |
|---|---|---|---|
| 4,142,307 | 3/1979 | Martin | 36/117 X |
| 4,825,566 | 5/1989 | Sartor | 36/119 X |
| 4,841,650 | 6/1989 | Dodge et al. | 36/119 |
| 4,914,839 | 4/1990 | Paris et al. | 36/119 |
| 4,937,953 | 6/1990 | Walkhoff | 36/119 |
| 4,949,480 | 8/1990 | Hercog et al. | 36/119 |
| 4,977,692 | 12/1990 | Iwama et al. | 36/119 |
| 5,020,248 | 6/1991 | Hercog et al. | 36/117 X |
| 5,030,340 | 7/1991 | Hilgarth | 36/119 X |

FOREIGN PATENT DOCUMENTS

| | | | |
|---|---|---|---|
| 2381483 | 10/1978 | France | 36/119 |
| 2469885 | 6/1981 | France | 36/119 |
| 2547206 | 12/1984 | France | 36/119 |
| 2547487 | 12/1984 | France | 36/119 |
| 2607368 | 6/1988 | France | 36/119 |

*Primary Examiner*—Paul T. Sewell
*Assistant Examiner*—Beth Anne Cicconi
*Attorney, Agent, or Firm*—Pollock, Vande Sande & Priddy

[57] ABSTRACT

Alpine ski boot comprising a rigid shell base (2, 3) surmounted by an upper (1), the shell base being made in two pieces assembled together, i.e., a lower part (2) opening upward and extending substantially over the entire length of the boot and an upper part (3) extending above the front part of the foot and constituting a closing cover. The upper closing cover (3) carries a tightening arrangement (13) forming part of an internal foot position maintenance device (14).

21 Claims, 3 Drawing Sheets

SKI BOOT CLOSING COVER WITH TIGHTENING DEVICE

FIELD OF THE INVENTION

The present invention relates to an alpine ski boot comprising a rigid shell base surmounted by an upper composed of one or two pieces.

BACKGROUND OF THE INVENTION assignee's French Patent No. FR-A-2 607 368 provides a description of conventionally-known alpine ski boots of this kind whose shell base is comprising two assembled pieces, i.e., a lower part opening upward which extends substantially over the entire length of the boot and may enclose the heel of the skier, and an upper part extending above the front part of the foot and forming a rigid closing cover. The attachment joining the upper closing cover and the lower part of the shell base may comprise any conventional assembly means, particularly reciprocal rivets. Furthermore, the boot is equipped with an internal foot position maintenance device which makes it possible to hold the skier's foot more or less tightly within the shell base, in order to create firm contact between the skier's foot and the boot when skiing.

SUMMARY OF THE INVENTION

The present invention concerns improvements made to this boot, essentially for the purpose of facilitating its manufacture.

For this purpose, this alpine ski boot having a rigid shell base surmounted by an upper, the shell base being formed from two assembled pieces, i.e., a lower part opening upward and extending substantially over the entire length of the boot, and an upper part extending above the front part of the foot and forming a closing cover, is characterized by the fact that the upper closing cover carries tightening means forming part of an internal foot position maintenance device.

BRIEF DESCRIPTION OF THE DRAWINGS

Several embodiments will be described below as examples of the present invention with reference to the attached drawings, in which.

DESCRIPTION OF THE PREFERRED EMBODIMENTS

Figure 1:
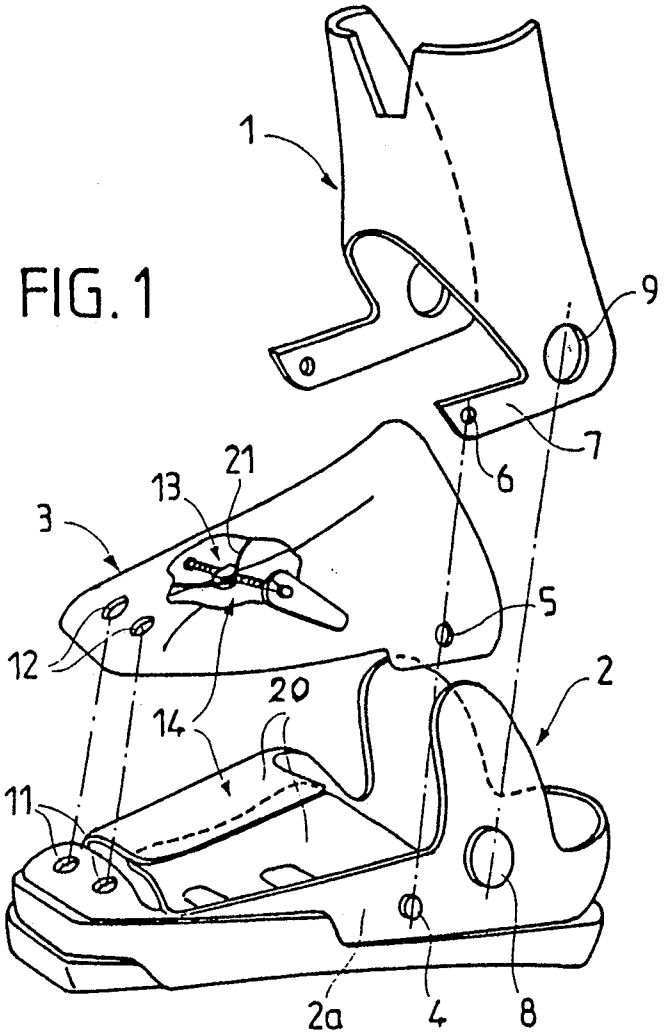
FIG. 1 is an exploded perspective view of an alpine ski boot according to the invention.
Figure 5:
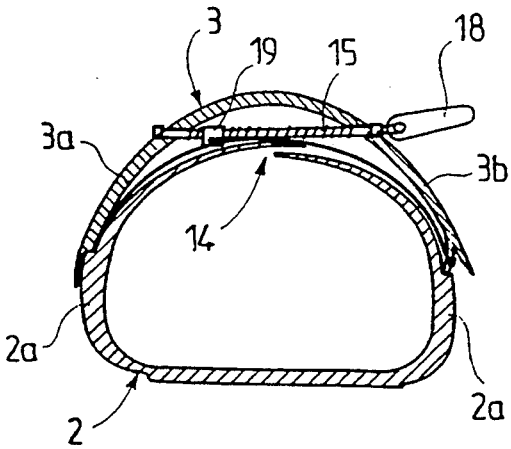
FIG. 5 is a vertical and transverse cross-section of the lower part of the shell base and of the closing cover after assembly.

The alpine ski boot in FIG. 1 comprises on its upper, rear part, an upper 1 made of one or two pieces which encloses the lower part of a skier's leg and which is attached to the rigid shell base. This shell base composed of two pieces comprises a lower part 2 open at the top and along the entire length of the foot, and possibly enclosing the skier's heel, as shown in FIG. 1, and an upper closing cover 3 which covers the front portion of the lower part 2 of the shell base. This upper closing cover 3 is generally made of a molded plastic material and has a shape which complements that of the lower part 2 of the shell base (also made of a molded plastic material), so as to delimit a housing for the front part of the skier's foot when these two elements are fastened together, as shown in FIG. 5. The assembly of the upper closing cover 3 and of the lower part 2 of the shell base may be achieved using any suitable means, rivets for example. In the embodiment in FIG. 1, the rear lower part of the upper closing cover 3 is assembled with the lower part 2 of the shell base using two mounting rivets 4 which are unitary with the two lateral walls 2*a* of the lower part 2 of the shell base and pass through the holes 5 in the rear and lower parts of the cover 3. In this case, the rivets 4 are also used to fasten the upper 1 onto the shell base, since they pass respectively through holes 6 provided in lower lateral flaps 7 which prolong frontward the lower part of the upper 1. The upper 1 is, furthermore, attached to the lower part 2 of the shell base using two rivets 8 transversely aligned and unitary with the rear parts of the lateral walls 2*a* of the lower part 2 of the shell base, and which pass through transversely-aligned holes 9 in the lower parts of the two lateral flaps of the upper 1. Furthermore, the front part of the upper closing cover 3 is also made unitary with the front of the lower part 2 of the shell base 2 using rivets 11 placed on this lower part 2 and inserted through holes 12 provided in the front part of the cover 3.

According to the invention, the upper closing cover 3 carries tightening means 13 forming part of an internal foot position maintenance device 14. In the embodiment shown in FIGS. 2 to 5, this internal foot position maintenance device 14 comprises two tongues 20 emanating from the two lateral walls 2*a*, respectively, of the lower part 2 of the shell base. These two tongues 20 molded together with the lateral walls 2*a* of the lower part 2 of the shell base, or fastened to these walls, curve toward each other when at rest, and may possibly overlap slightly at their ends. These two tongues 20 extending above the front part of the skier's foot act as pressure-distribution plates. When the upper closing cover 3 is assembled to the lower part 2 of the shell base, as shown in FIG. 5, the tightening means 13 positioned inside the cover 3 extend above the two tongues 20 in position to exert more or less pronounced pressure downward on these tongues, in order to ensure the firm position maintenance of the skier's foot inside the shell base.

In the embodiment shown in FIGS. 2 to 5, the foot-tightening means 13 comprise a threaded shaft 15 extending horizontally and transversely within the upper part of the cover 3. This shaft 15 is mounted so as to allow its rotation but prevent its axial translational motion. One of the ends of the shaft 15 turns in a bearing formed by a hole 16 provided in a lateral wall 3*a* of the cover 3. The opposite, smooth end piece of the shaft 15 extends through another hole 17 pierced in the opposite lateral wall 3*b* of the cover 3 and aligned with the first hole 16. The shaft 15 is thus prolonged on the outside of the cover 3 and at its outer end, and is connected to an operating lever 18 which allows it to be turned on itself.

Figure 2:
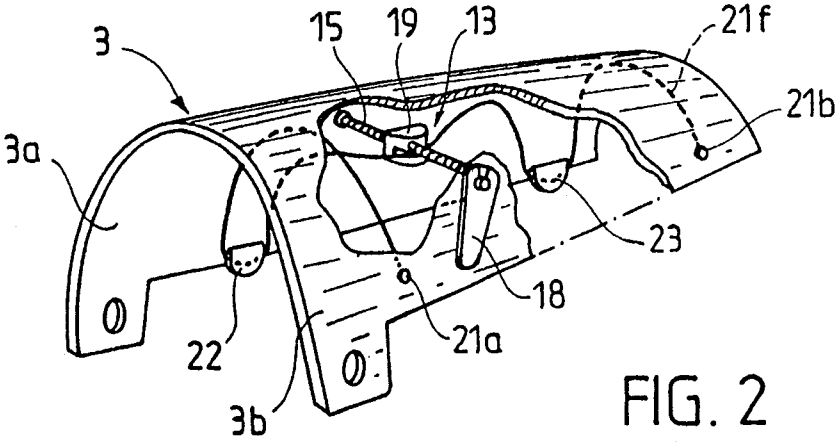
FIG. 2 is a perspective view, partially broken away of one embodiment of the upper closing cover of the shell base.
Figure 3:
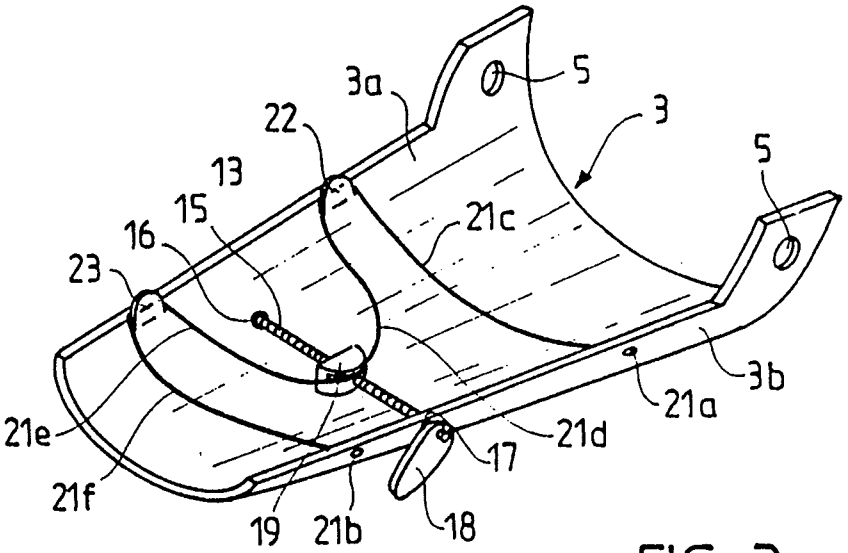
FIG. 3 is a perspective view of the closing cover turned upside down.
Figure 4:
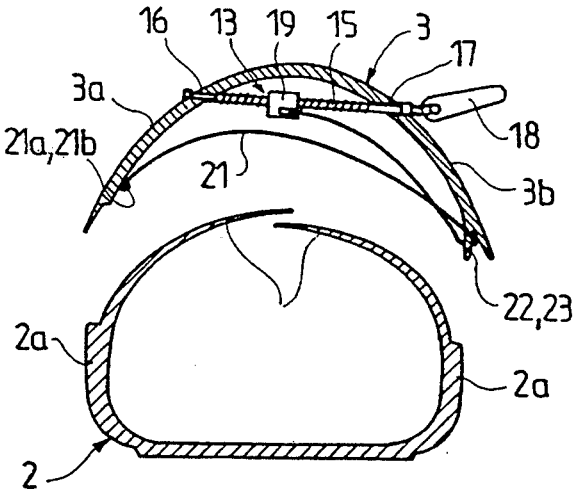
FIG. 4 is a vertical and transverse cross-section of the lower part of the shell base and of the closing cover before assembly.

Inside the cover 3, the shaft 15 carries a slide piece 19 constituted by a nut screwed on the shaft 15 which may thus be moved transversely when the threaded shaft 15 is turned on itself by working the external operating lever 18. Slide piece 19 serves to tighten to a greater or lesser degree a cable 21 which follows, inside the cover 3, a sinuous path which may be a zigzag, wavy, or substantially M-shaped, as shown in FIGS. 2 and 3. In this latter case, the cable 21 is hooked by one of its ends 21*a* to one of the lateral walls 3*a* of the cover 3 at a rear anchoring point and by its other end 21*b* to a forward anchoring point on the same lateral wall 3*a*. Furthermore, the opposite lateral wall 3*b* of the cover 3 has two longitudinally-spaced tabs 22 which may be substantially transversely aligned with the anchoring points of the two ends 21*a* and 21*b* of the cable 21. Beginning at its rear extremity 21*a*, cable 21 thus forms a first tightening section of cable 21*c* extending substantially transversely to the opposite tab 22; it passes around this tab 22 and then upward toward the slide piece 19, thereby creating a tension-bearing cable section 21*d*. It follows the profile of slide piece 19 and then moves down toward the other tab 23, thus forming a second tension-bearing section 21*e* before finally forming a second tightening section 21*f* extending substantially transversely between tab 23 and the front end 21*b* of the cable. Accordingly, during manufacture of the boot, the cover 3 is made with its tightening means in place, these means comprising the threaded shaft 15, the operating lever 18, the slide piece 19, and the cable 21 already arranged in its M-shaped path. Next, after assembly of the upper closing cover 3 to the lower part 2 of the shell base, the tightening means 13 are positioned immediately above and in contact with the pressure-distribution tongues 20, with which they compose the internal foot position maintenance device 14. When the skier wishes to tighten his foot in the shell base, he turns the threaded shaft 15 in the direction which produces the tightening, by working the operating lever 18, thus producing a translational movement of the slide piece 19 entailing the generation of tension on the cable 21 and the application under pressure of its tightening sections 21*c*, 21*b* transversely on the tongues 20, in order to press these tongues on the upper part of the foot.

Figure 6:
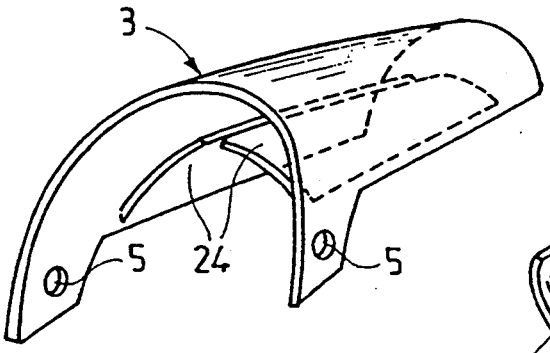
FIG. 6 is a perspective view of another embodiment of the closing cover.
Figure 7:
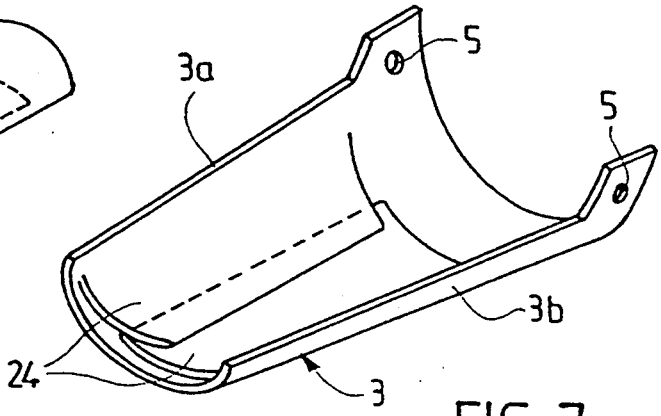
FIG. 7 is a perspective view of the closing cover in FIG. 6, turned upside down.
Figure 8:
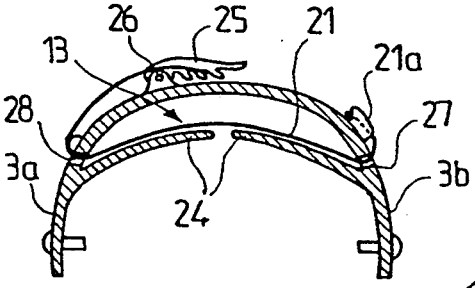
FIG. 8 is a vertical and transverse cross-section of the closing cover in FIGS. 6 and 7.

In the embodiment shown in FIGS. 6 to 8, the upper closing cover 3 carries all of the means making up the internal foot position maintenance device of the boot. For this purpose, the cover 3 itself carries, beneath the tightening means 13, two pressure-distribution tongues 24 emanating from the two lateral walls 3*a*, 3*b*, respectively, of the cover 3, extending toward each other, and possibly overlapping. The tongues 24 may be molded simultaneously with the rest of the upper cover or may be attached to the cover using any suitable means. The tightening cable 21 extends above the tongues, tension being, in this case, applied to the cable using a tightening lever jointed to the upper wall of the cover 3 around a pin 26. This pin 26, which is supported by bearings molded with, or fastened to,the wall of the cover 3 or preferably extends longitudinally.

Figure 9:
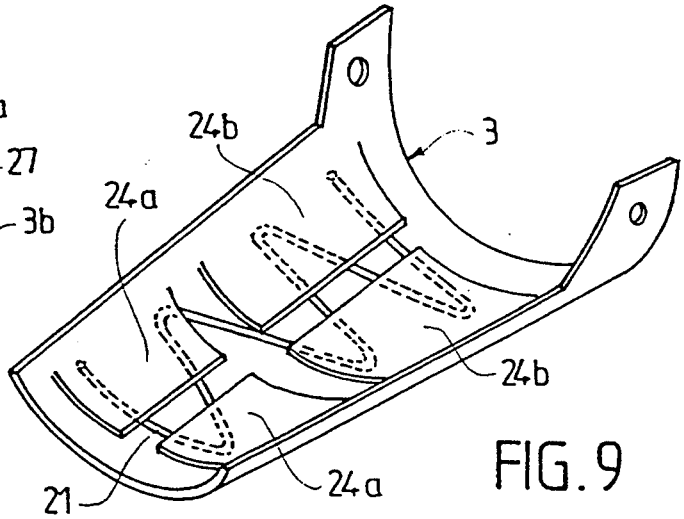
FIG. 9 is a perspective view of another embodiment of the closing cover turned upside down.

As shown more particularly in FIG. 8, the cable 21 is attached by its end 21*a* to the outside of the lateral wall 3*b* of the cover 3. It then extends inside the cover 3 by passing through a hole 27 pierced in the lateral wall 3*b*, and then extends transversely or by following a sinuous path above the tongues 24. It then emerges on the outside of the opposite side by passing through a hole 28 pierced in the lateral wall and is hooked by its end to the tightening lever 25, which may pivot transversely on the upper part of the cover 3. The tongues 24 borne inside the cover 3 may extend substantially over the greater part of the length of this cover, as shown in FIG. 6, each of which constitutes a single piece. According to a variant show in FIG. 9, the tongues may be subdivided in several parts 24*a*, 24*b* separated from each other longitudinally, all of the various individual tongues 24*a*, 24*b* being pressed down on the upper part of the foot by means of the cable 21 when the same is under tension In the embodiment shown in FIG. 10, the tightening cable 21 is hooked by its end 21*a* to the end of the upper tongue 24. It then extends transversely or along a sinuous path and emerges on the outside of the cover 3 by passing through a hole 28 pierced in the lateral wall 3*a* before being connected to the operating lever 25. In the tightened position, this operating lever is kept in a horizontal position on the upper part of the cover 3 and is held in this position while being pressed against a projection 29 located on the outside of the cover 3 on the same side of the latter as the hole 28 from which the cable 21 emerges.

Figure 10:
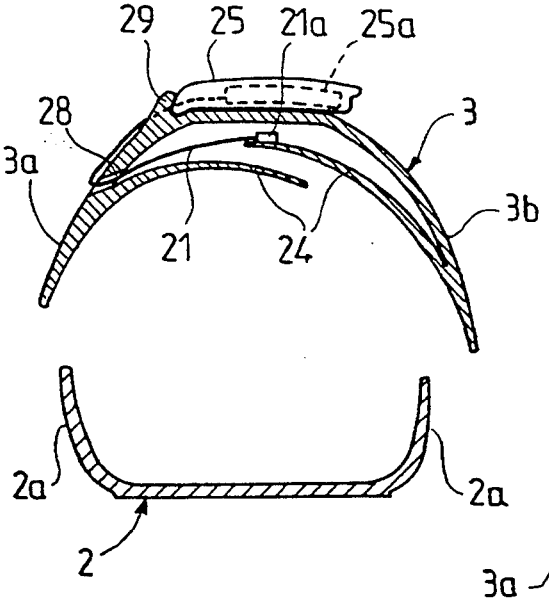
FIG. 10 is a vertical and transverse cross-section of another embodiment of the closing cover before assembly with the lower part of the shell base.

In the two embodiments illustrated in FIGS. 8 and 10, the operating lever 25 is advantageously fitted with means allowing adjustment of the tension of the cable 21 in the tightened position. In FIG. 8, the operating lever 25 is fitted conventionally with several spaced notches in which the cable 21 may be hooked. In the embodiment illustrated in FIG. 10, the operating lever 25 is fitted with adjustment means 25*a* making it possible to continuously vary the tension of the cable 21.

Figure 11:
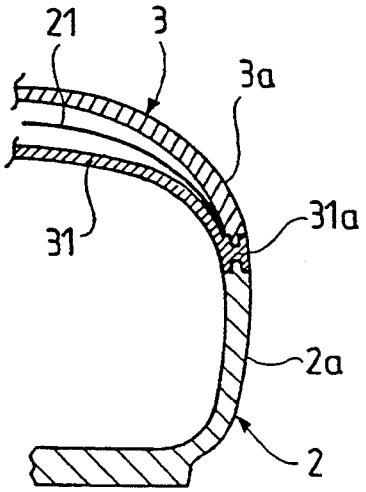
FIG. 11 is a vertical and transverse cross-section of another embodiment of the boot.

FIG. 11 represents an embodiment in which each pressure-distribution tongue 31 is formed from an independent piece whose outer end 31*a* is held in a sandwich arrangement and immobilized between the edges of lateral walls 3*a* of the cover 3 and 2*a* of the lower part 2 of the shell base.

Figure 12:
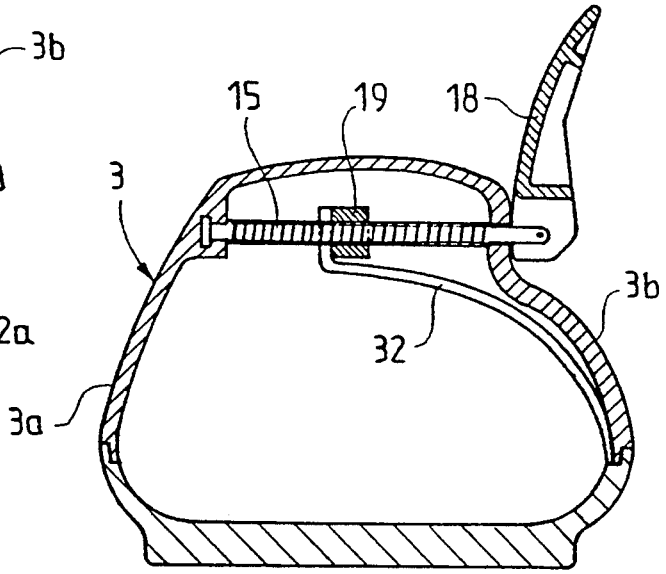
FIGS. 12 and 13 are vertical and transverse cross-sections of boots fitted with variants of the internal foot position maintenance device.

In the embodiment shown in FIG. 12, the slide piece 19 forming a nut screwed on the transverse threaded shaft 15 is unitary with the upper end of a rigid pressure-distribution plate 32 having a curved transverse section whose concavity faces downward and which extends in proximity to the lateral wall 3*b* of the upper closing cover 3. The entire pressure plate may thus be moved as a result of the rotation of the threaded shaft 15, so as to press the skier's foot downward toward the opposite lateral wall 3*a* of the cover 3.

Figure 13:
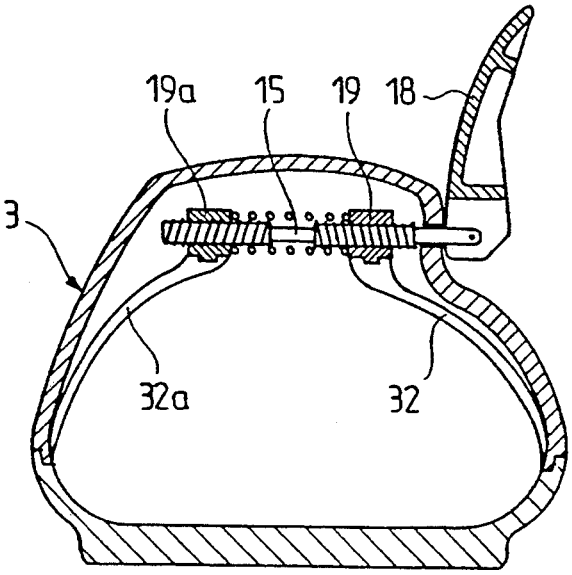

FIG. 13 represents an embodiment in which the transverse threaded shaft 15 controls the motion of two slide pieces 19 and 19*a*, each moving in a direction opposite that of the other, forming nuts screwed respectively on two sets of threads whose pitches are reversed on shaft 15. These slide pieces 19 and 19*a* are connected respectively to two rigid pressure-distribution plates 32, 32*a* which are in contact with the skier's foot and which may be moved toward each other to ensure tightening of the foot.

what is claimed is:

1. Alpine ski boot comprising a rigid shell base (2, 3) surmounted by an upper (1), said shell base being made of two pieces assembled together, i.e., a lower part (2) opening upward, comprising lateral walls (2*a*), and extending substantially over the entire length of the boot, and an upper closing cover (3) extending above the front part of the foot, comprising two opposite lateral walls (3*a*, 3*b*), wherein said upper closing cover (3) bears tightening means (13) forming part of an internal foot position maintenance device (14) and comprising a cable (21) extending between the two lateral walls (3*a*, 3*b*) of said upper closing cover (3) and means for generating tension of said cable (21), said cable (21) extending above at least one tongue (15, 24, 31) constituting a pressure-distribution element.

2. Alpine ski boot according to claim 1, including two said tongues, wherein said cable (21) extends above said two tongues (15, 24, 31) emanating respectively from said two opposite lateral walls and having overlapping ends.

3. Alpine ski boot according to claim 2, wherein each pressure-distribution tongue (15) emanates from one of said lateral walls (2*a*) of said lower part (2) of said shell base.

4. Alpine ski boot according to claim 1, wherein each pressure-distribution tongue (24) emanates from one of said lateral walls (3*a*, 3*b*) of said upper closing cover (3).

5. Alpine ski boot according to claim 3, wherein each pressure-distribution tongue (15, 24) is molded simultaneously with the lateral wall (2*a*, 3*a*, 3*b*) from which it originates.

6. Alpine ski boot according to any of claim 2, wherein each pressure-distribution tongue (15, 24) extends over a substantial portion of the length of said upper closing cover (3) and of the lower part (3) of said shell base.

7. Alpine ski boot according to any of claim 2, wherein said boot comprises several individual pressure-distribution tongues (24*a*, 24*b*) separated longitudinally one from the others.

8. Alpine ski boot according to any of claims 2 to 4, wherein each of said pressure-distribution tongues (31) is a separate piece and its external end (31*a*) is immobilized in a sandwich between the ends of said lateral walls (3*a*, 2*a*) of said upper closing cover (3) and of said lower part (2) of said shell base.

9. Alpine ski boot according to any of claim 1, wherein said tightening means comprise at least one slide piece (19) forming a nut screwed on a threaded shaft (15) extending horizontally and transversely within the upper part of said upper closing cover (3), wherein said shaft (15) is mounted so as to rotate while being prevented from moving in axial translational motion, said shaft (15) extending through a hole (17) pierced in a lateral wall (3*b*) of said upper closing cover (3) and by the outer end of which said shaft (15) is connected to an operating lever (18).

10. Alpine ski boot according to claim 9, wherein said cable (21) follows a sinuous path across said upper closing cover (3) and passes onto said slide piece (19) which is movable in translation motion.

11. Alpine ski boot according to claim 10, wherein said cable (21) follows a substantially M-shaped path and is hooked by one of its ends (21*a*) to one of said lateral walls (3*a*) of said cover (3) at a rear anchoring point and, by its other end (21*b*) to a front anchoring point on said same lateral wall (3*a*), the opposite lateral wall (3*b*) of said cover (3) having two longitudinally-spaced tabs (22, 23) which may be aligned substantially transversely with said points of anchoring of said two ends (21*a*, 21*b*) of said cable (21), so that, beginning at its posterior end (21*a*), said cable (21) forms a tightening section of cable (21*c*) extending substantially transversely until it reaches the opposite tab (22), around which said cable passes before turning upward toward said transversely-movable slide piece (19), thus forming a tension-bearing section (21*d*), and subsequently following the profile of said slide piece (19) before moving downward toward the other tab (23), thereby forming a second tension-bearing section (21*e*), and finally forming a second tightening section (21*f*) extending substantially transversely between said tab (23) and the front end (21*b*) of said cable.

12. Alpine ski boot according to claim 9, wherein said transversely movable slide piece (19) is unitary with the upper end of a rigid pressure-distribution plate (32) having a curved transverse section whose concavity faces downward and extending above the front part of the skier's foot.

13. Alpine ski boot according to claim 9, wherein said tightening means comprise two slide s (19, 19*a*) forming nuts screwed on threads having pitches that are equal but extend in opposite directions borne by the threaded shaft (15), said two slide piece forming nuts (19, 19*a*) being unitary respectively with the upper ends of two rigid pressure-distribution plates (32, 32*a*) extending downward which have a curved vertical and transverse section whose concavity faces downward and which together tighten the foot.

14. Alpine ski boot according to any of claim 1, wherein said cable (21) passes through a hole (28) pierced in one of said lateral walls (3*a*) of said upper closing cover (3) and extend toward a tightening lever (25) to which it is connected, said tightening lever (25) being movably mounted on said upper closing cover (3).

15. Alpine ski boot according to claim 14, wherein said cable (21) is hooked by its second end (21*a*) to said upper closing cover (3).

16. Alpine ski boot according to claim 15, wherein said cable (21) passes through a hole (27) pierced in the second lateral wall (3*b*) of said upper closing cover (3).

17. Alpine ski boot according to claim 14, wherein said cable (21) is hooked by its second end (21*a*) to the end of an upper pressure-distribution tongue (24) emanating from said lateral wall (3*b*) of said upper closing cover (3) opposite said lateral wall (3*a*) containing said hole (28) through which said cable passes in the direction of said tightening lever (25).

18. Alpine ski boot according to any of claim 14, wherein said tightening lever (25) is fitted with means (25*a*) for adjusting the tension of said cable (21).

19. Alpine ski boot according to any of claim 14, wherein said tightening lever (25) is mounted so as to pivot on the upper part of said cover (3) around a longitudinal pin (26).

20. Alpine ski boot according to any of claim 14, wherein, when in tightening position, said operating lever (25) is held in a horizontal position on the upper part of said closing cover (3) while being pressed against a projecting piece (29) on said cover (3) which is located on the side of said cover containing said hole (3) through which said cable (21) emerges to the outside of said cover (3).

21. Alpine ski boot according to claim 3, wherein each pressure-distribution tongue is fastened to the lateral wall from which it originates.

* * * * *